US009188903B2

(12) United States Patent
Yoshioka

(10) Patent No.: US 9,188,903 B2
(45) Date of Patent: Nov. 17, 2015

(54) IMAGE FORMING DEVICE, BIAS VOLTAGE CONTROL METHOD FOR IMAGE FORMING DEVICE, AND COMPUTER PROGRAM PRODUCT

(71) Applicant: Yu Yoshioka, Tokyo (JP)

(72) Inventor: Yu Yoshioka, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/476,920

(22) Filed: Sep. 4, 2014

(65) Prior Publication Data

US 2015/0071663 A1 Mar. 12, 2015

(30) Foreign Application Priority Data

Sep. 9, 2013 (JP) ..... 2013-186679

(51) Int. Cl.
*G03G 15/06* (2006.01)
*G03G 15/00* (2006.01)
*G03G 15/02* (2006.01)

(52) U.S. Cl.
CPC ..... *G03G 15/065* (2013.01); *G03G 15/0283* (2013.01); *G03G 15/80* (2013.01)

(58) Field of Classification Search
CPC .. G03G 15/0283; G03G 15/065; G03G 15/80
See application file for complete search history.

(56) References Cited

U.S. PATENT DOCUMENTS 5,619,316 A * 4/1997 Shoji et al. ..... 399/359
5,666,591 A * 9/1997 Taya ..... 399/50
5,761,589 A 6/1998 Kido et al.

FOREIGN PATENT DOCUMENTS

JP 10-247007 9/1998
JP 3507571 12/2003
JP 2012-053350 3/2012

* cited by examiner

*Primary Examiner* — Sandra Brase
(74) *Attorney, Agent, or Firm* — Oblon, McClelland, Maier & Neustadt, L.L.P.

(57) ABSTRACT

An image forming device includes a charging power supply used in applying, to a charging unit, a charging voltage for the purpose of electrostatic latent image formation and a charging bias voltage during a cleaning operation; a developing power supply that is capable of outputting a developing bias voltage of positive polarity and negative polarity to a developing unit; a constant-voltage generating-holding unit that is used in generating and holding a constant potential difference between the charging unit and the developing unit; a developing power control unit that performs output control of a developing bias voltage with respect to the developing unit; and a charging power control unit that, when the developing power control unit performs control to output a developing bias voltage of reverse polarity to the charging unit, performs output control of the charging bias voltage of a predetermined level with respect to the charging power supply.

7 Claims, 11 Drawing Sheets

IMAGE FORMING DEVICE, BIAS VOLTAGE CONTROL METHOD FOR IMAGE FORMING DEVICE, AND COMPUTER PROGRAM PRODUCT

CROSS-REFERENCE TO RELATED APPLICATIONS

The present application claims priority to and incorporates by reference the entire contents of Japanese Patent Application No. 2013-186679 filed in Japan on Sep. 9, 2013.

BACKGROUND OF THE INVENTION

1. Field of the Invention

The present invention relates to an image forming device, a bias voltage control method for the image forming device, and a computer program product.

2. Description of the Related Art

In an image forming device, with the aim of achieving reduction in the cost of a high-voltage power supply board, a technology is known in which an imaging sequence and an output constraint are set and a common transformer is used for charging and developing purposes; or a technology is known in which a constant-voltage element is configured in between outputs, and the output bias potential difference is maintained at a constant level so as to reduce the terminals of a high-voltage output unit.

For example, in Japanese Patent Application Laid-open No. 2012-53350, a technology is disclosed in which, with the aim of achieving reduction in the cost of a high-voltage power supply, a common transformer is used for a charging grid and a developing output. Moreover, a technology is disclosed in which constant-voltage elements are connected in between a regulation output and a developing output of a developing device, and the potential; difference between those outputs is maintained at a constant level. With that, in a high-voltage output unit, it becomes possible to use the same terminal for the regulation output and the developing output without making the circuitry complex (for example, see Japanese Patent No. 3507571).

However, in the conventional technologies mentioned above, in the case in which developing of reverse polarity to the polarity of charging is to be output for the purpose of cleaning a photosensitive member, it is not possible to obtain the desired potential difference between the constant-voltage elements. Hence, it is not possible to perform photosensitive member cleaning in a stable manner.

In view of the issues mentioned above, there is a need to enable cleaning of a photosensitive member in a stable manner without making the circuitry complex.

SUMMARY OF THE INVENTION

It is an object of the present invention to at least partially solve the problems in the conventional technology.

According to the present invention, there is provided an image forming device comprising: a charging power supply that is used in applying, to a charging unit, a charging voltage for the purpose of electrostatic latent image formation and a charging bias voltage during a cleaning operation; a developing power supply that is capable of outputting a developing bias voltage of positive polarity and negative polarity to a developing unit; a constant-voltage generating-holding unit that is used in generating and holding a constant potential difference between the charging unit and the developing unit; a developing power control unit that performs output control of a developing bias voltage with respect to the developing unit; and a charging power control unit that, when the developing power control unit performs control to output a developing bias voltage of reverse polarity to the charging unit, performs output control of the charging bias voltage of a predetermined level with respect to the charging power supply.

The present invention also provides a bias voltage control method for an image forming device that includes a charging power supply that is used in applying, to a charging unit, a charging voltage for the purpose of electrostatic latent image formation and applying a charging bias voltage during a cleaning operation, a developing power supply that is capable of outputting a developing bias voltage of positive polarity and negative polarity to a developing unit, and a constant-voltage generating-holding unit that is used in generating and holding a constant potential difference between the charging unit and the developing unit, the bias voltage control method for an image forming device, comprising: developing-power-controlling that includes performing output control of a developing bias voltage with respect to the developing unit; and charging-power-controlling that, when a developing bias voltage of reverse polarity is output to the charging unit at the developing-power-controlling, includes performing output control of the charging bias voltage of a predetermined level with respect to the charging power supply.

The present invention also provides a computer program product comprising a non-transitory computer readable medium having a computer program executed by a computer, wherein the computer includes; a charging power supply that is used in applying, to a charging unit, a charging voltage for the purpose of electrostatic latent image formation and applying a charging bias voltage during a cleaning operation, a developing power supply that is capable of outputting a developing bias voltage of positive polarity and negative polarity to a developing unit, and a constant-voltage generating-holding unit that is used in generating and holding a constant potential difference between the charging unit and the developing unit, and the program causes the computer to execute: developing-power-controlling that includes performing output control of a developing bias voltage with respect to the developing unit; and charging-power-controlling that, when a developing bias voltage of reverse polarity is output to the charging unit at the developing-power-controlling, includes performing output control of the charging bias voltage of a predetermined level with respect to the charging power supply.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of an image forming device, a bias voltage control method for the image forming device, and a computer program product according to the present invention is described in detail below with reference to the accompanying drawings.

Embodiment

In an image forming device in which, developing of reverse polarity to the polarity of charging is output for the purpose of cleaning a photosensitive member, the present invention has the following features. Thus, a charging bias voltage is applied that is adjusted in such a way that the photosensitive member does not get charged during a developing output of reverse polarity to the polarity of charging. As a result, a current path is created for constant-voltage elements so that the potential difference of a developing roller, a regulating blade, and a feed roller becomes stable. That enables cleaning of the photosensitive member in a stable manner without making the circuitry complex. Given below is the explanation of a specific example.

Figure 1:
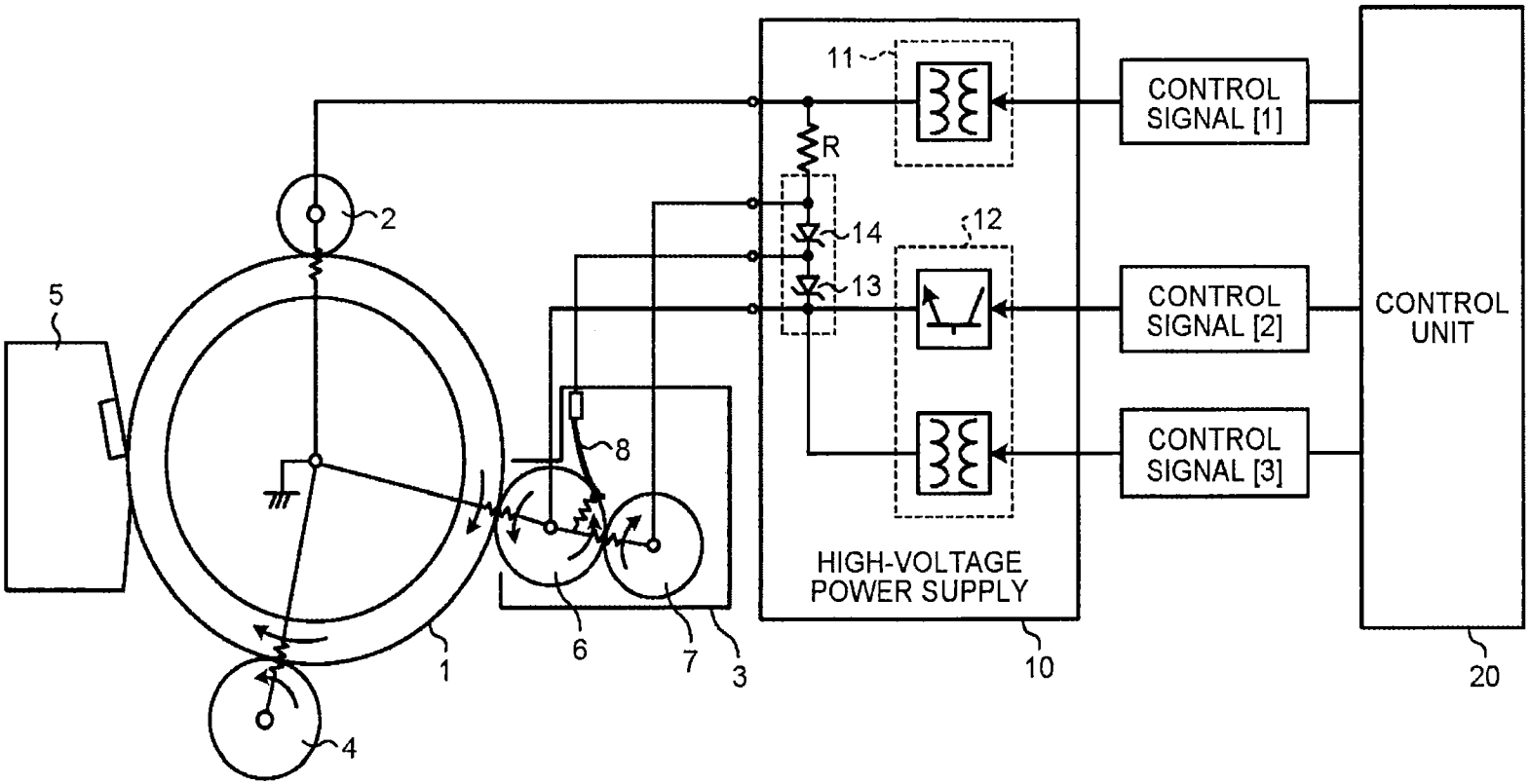
FIG. 1 is an explanatory diagram illustrating a configuration of the relevant part of an image forming device according to an embodiment.

FIG. 1 is an explanatory diagram illustrating a configuration of the relevant part of an image forming device according to the present embodiment. The image forming device such as a copying machine, a facsimileing machine, or a printer includes a photosensitive member 1 that serves as an image carrier in an image forming configuration required in forming an image on a recording medium, such as a paper sheet, based on image information in the form of electronic information. In this image forming device, an image forming system is configured according to the known electrophotographic process. That is, around the photosensitive member 1 on which an electrostatic latent image is formed, a mechanism is disposed to carry out various operations such as charging, exposing, developing, transferring, and cleaning during image formation. In FIG. 1, it is illustrated that the photosensitive member 1 is surrounded by a charging roller 2, a developing unit 3, a transfer roller 4, and a cleaning unit 5. Meanwhile, in FIG. 1, although only a single photosensitive member 1 is illustrated; a color image forming device includes a plurality of photosensitive members corresponding to the number of toner colors. Moreover, although the image forming apparatus explained herein has an image forming system configured according to the electrophotographic process, the explanation is not given about the configuration related to the exposing system.

The image forming apparatus further includes a high-voltage power supply 10 that supplies a predetermined high-voltage power to the charging roller 2 and the developing unit 3; and includes a control unit 20 that controls the output timing of the high-voltage power supply 10 using control signals. The high-voltage power supply 10 further includes circuits such as a charging power supply 11 that applies a high voltage to the charging roller 2; a developing power supply 12 that applies a developing bias voltage to the constituent elements of the developing unit 3; zener diodes 13 and 14 that function as constant-voltage generating-holding units; and a resistance R.

The charging roller 2 that functions as a charging unit makes contact with the photosensitive member 1 and uniformly charges the surface of the photosensitive member 1 with a charging voltage which enables formation of an electrostatic latent image on the photosensitive member 1. Moreover, the charging roller 2 is configured, as described later, to be applied with a charging voltage and a charging bias voltage (described later) at predetermined timings from the high-voltage power supply 10 under the control of the control unit 20. Meanwhile, although the explanation herein is given for an example in which the charging roller 2 functions as the charging unit, it is also possible to use another charging unit such as an electrostatic charger.

The developing unit 3 that functions as a developing device includes a developing roller 6, a feed roller 7, and a regulating blade 8 for housing a toner and supplying it to the electrostatic latent image formed on the surface of the photosensitive member 1. The developing roller 6 is disposed at a predetermined small distance from the surface of the photosensitive member 1. On the surface of the developing roller 6, the developer supplied by the feed roller 7 is regulated to a predetermined thickness by the regulating blade 8. Thus, with the aim of forming a toner layer on the surface of the developing roller 6, the regulating blade 8 is configured to come in contact with the developing roller 6 with a small distance or a small pressure therebetween. The developing roller 6, the feed roller 7, and the regulating blade 8 are applied with a predetermined bias voltage (described later) at a predetermined timing.

The transfer roller 4 applies a predetermined pressure to the photosensitive member 1 on which a toner image has formed, and transfers the toner image onto a sheet of recording paper. Herein, although the explanation is given for an example in which the transfer roller 4 functions as a transfer unit, it is also to use another transfer unit such as a transfer charger.

The cleaning unit 5 has a mechanism for removing and collecting the residual toner from the surface of the photosensitive member 1 after the transfer roller 4 has transferred the toner image. In this example, a cleaning blade abuts against the surface of the photosensitive member 1, and removes and collects the post-transfer residual toner from the surface of the photosensitive member 1.

At the time of performing an operation for forming an electrostatic latent image, a developing operation, and a cleaning operation; the control unit 20 controls the output of control signals [1] to [3] at predetermined timings so that the desired voltage generated by the high-voltage power supply 10 is biased to each constituent element.

Figure 2:
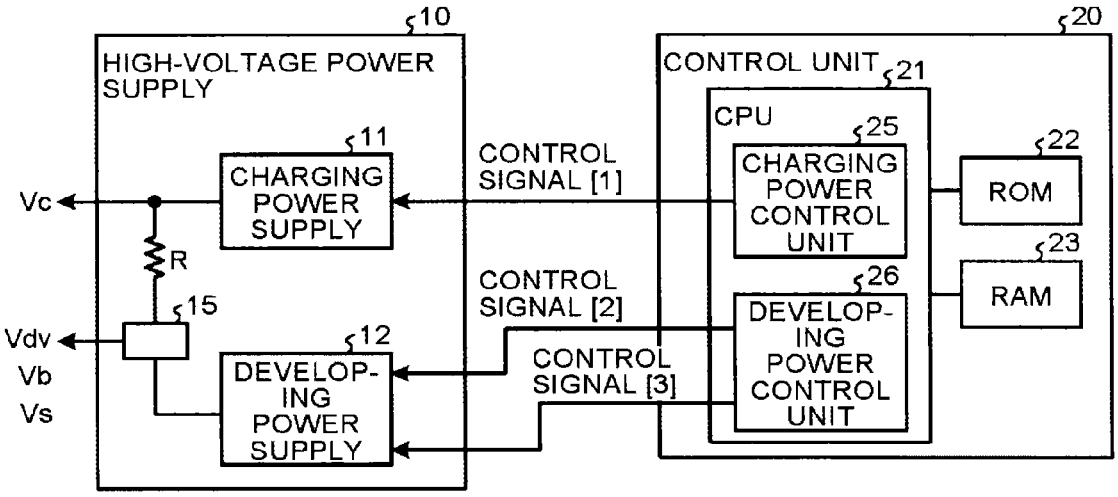
FIG. 2 is a block diagram illustrating a functional configuration of the relevant part of the image forming device.

In order to apply a bias voltage to the regulating blade 8 and the feed roller 7, constant-voltage elements (herein, the zener diodes 13 and 14) are connected, that functions as a constant-voltage generating-holding unit 15 (see FIG. 2). With such a configuration, using the current flowing from the developing output to the charging output, the required and desired potential difference is obtained with respect to the developing roller 6, the regulating blade 8, and the feed roller 7.

The output from the high-voltage power supply 10 is controlled with the control signals output from the control unit 20. Regarding the charging, the output voltage is adjusted using the control signal [1] (PWM). Regarding the developing, the control signal [3] (bias control) is switched ON so that the output bias is raised to the positive polarity, and switching between the positive polarity and the negative polarity can be done using the control signal [2] (PWM). Meanwhile, PWM stands for Pulse Width Modulation.

FIG. 2 is a block diagram illustrating a functional configuration. The control unit 20 includes a microcomputer system having a central processing unit (CPU) 21, a read only memory (ROM) 22, and a random access memory (RAM) 23. The CPU 21 also functions as a charging power control unit 25 and a developing power control unit 26.

The developing power control unit 26 performs output control of the developing bias voltage with respect to the developing unit 3. That is, the developing power control unit 26 outputs control signals to the developing power supply 12, and applies a predetermined bias voltage at a predetermined timing to the developing roller 6, the feed roller 7, and the regulating blade 8.

The charging power control unit 25 performs output control of a predetermined charging bias voltage at the time when the developing power control unit 26 outputs a developing bias voltage of reverse polarity to the polarity of the charging roller 2. That is, the charging power control unit 25 outputs control signals to the charging power supply 11 and applies a predetermined bias voltage at a predetermined timing to the charging roller 2.

Moreover, the charging power control unit 25 outputs a bias voltage that is not of the same electrical potential as the electrical potential of the rear end output of the constant-voltage generating-holding unit 15. Furthermore, the charging power control unit 25 outputs a charging bias voltage with which the photosensitive member 1 does not get charged. Moreover, the charging power control unit 25 varies the charging output according to the value of the developing bias voltage.

Meanwhile, instead of implementing the functions described above in the form of software (computer programs) executed by the CPU 21, it is also possible to implement some or all of those functions using hardware circuitry. That is, the charging power control unit 25 and the developing power control unit 26 can be partially or entirely implemented using hardware circuitry.

Figure 3:
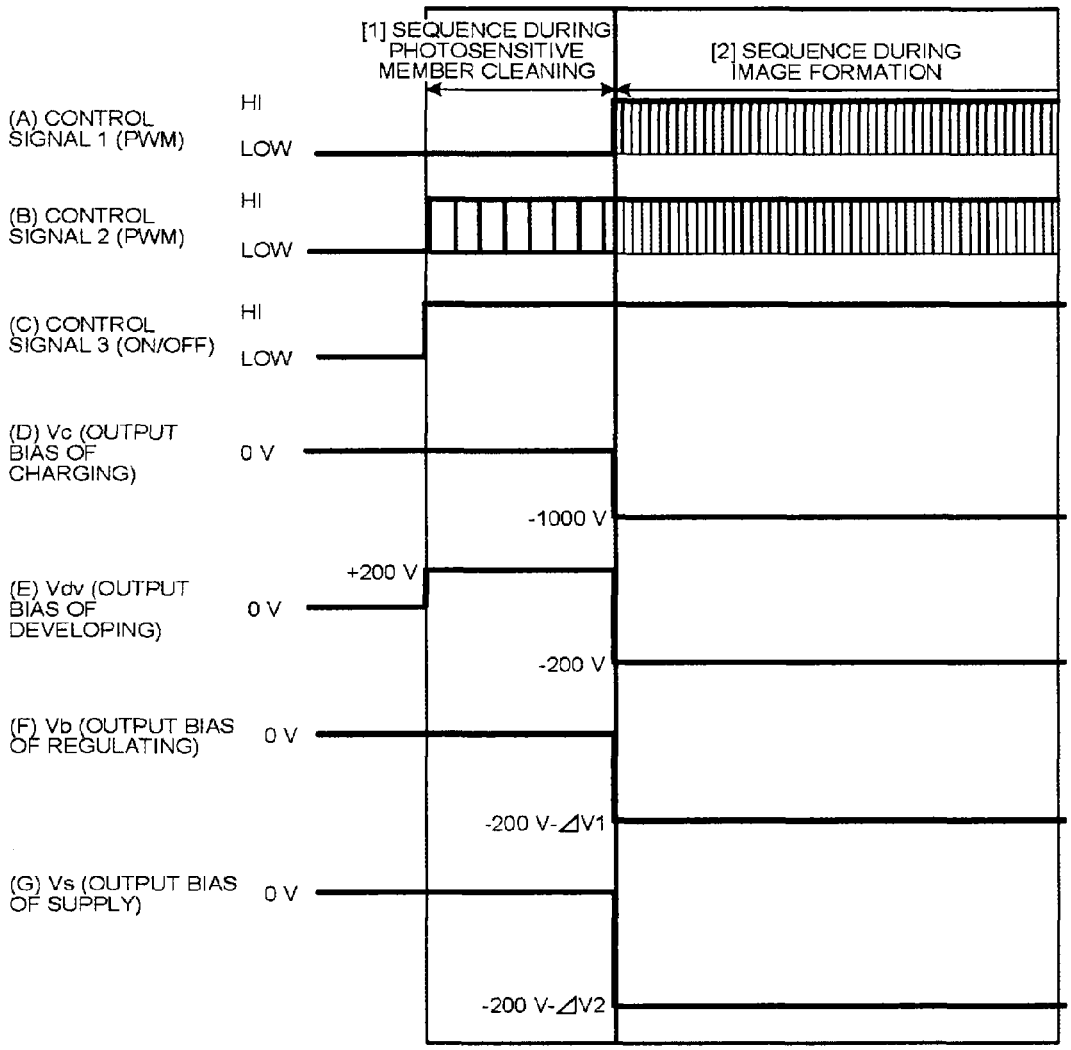
FIG.3 Related Art
FIG. 3 is a timing chart illustrating the conventional control sequence.
Figure 4A:
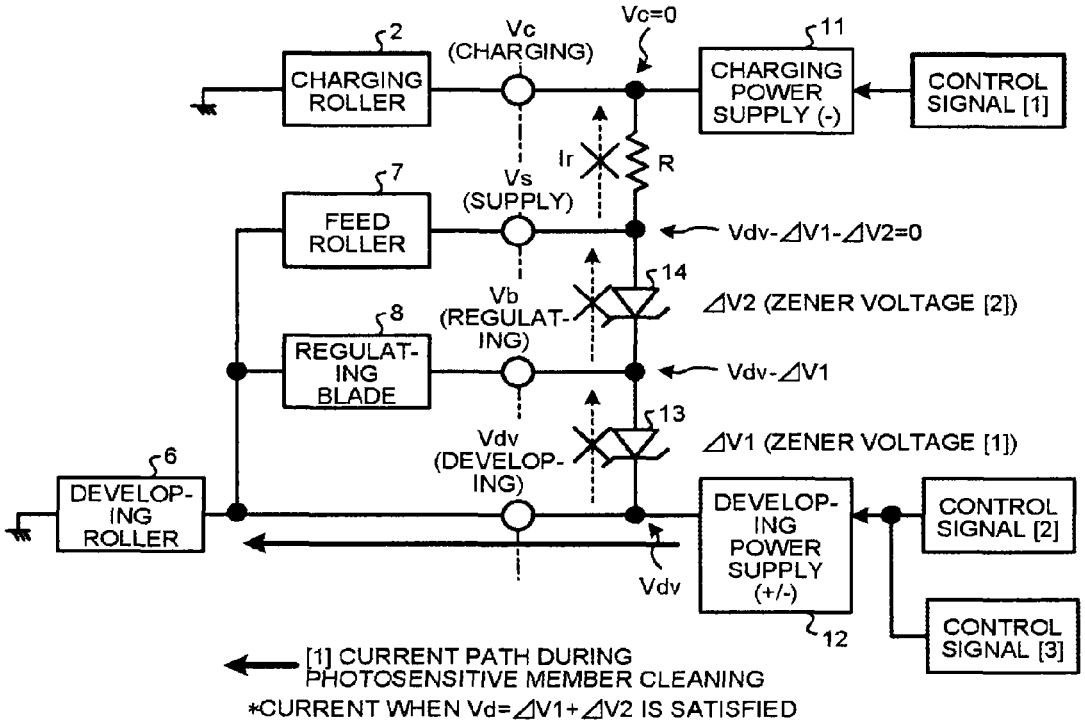
FIG.4A Related Art
FIG. 4A is a circuit diagram illustrating a current path for photosensitive member cleaning with reference to FIG. 3.
Figure 4B:
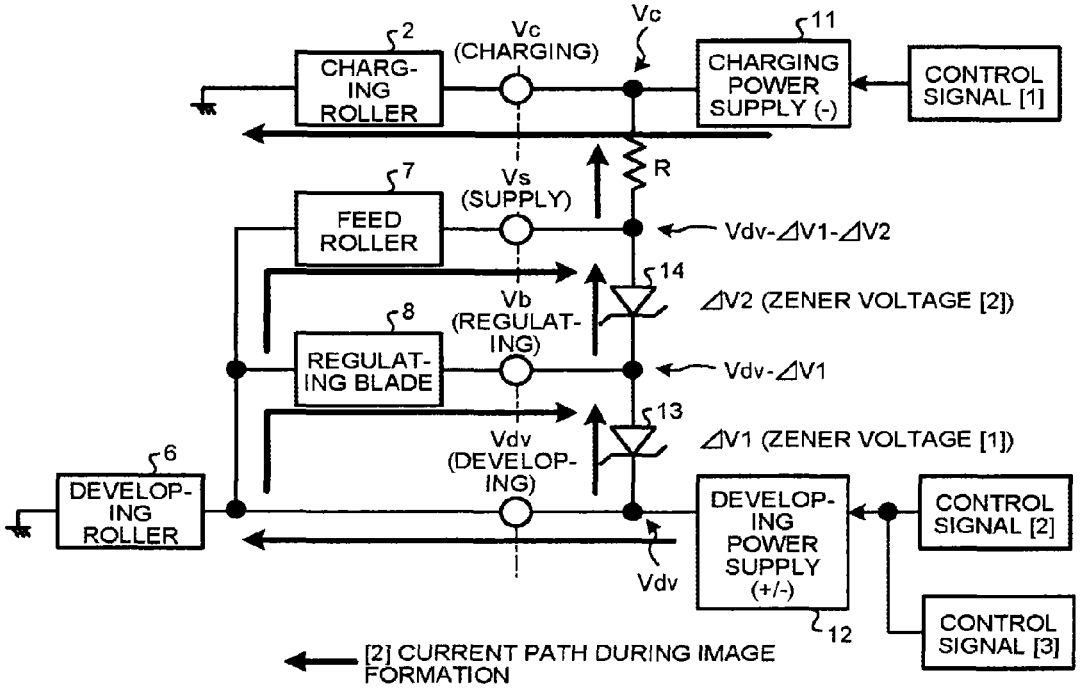
FIG.4B Related Art
FIG. 4B is a circuit diagram illustrating a current path for performing image formation with reference to FIG. 3.

Given below is the explanation of the conventional control sequence and the control sequence according to the present embodiment. FIG. 3 is a timing chart illustrating the conventional control sequence. FIG. 4A is a circuit diagram illustrating a current path for photosensitive member cleaning with reference to FIG. 3. FIG. 4B is a circuit diagram illustrating a current path for performing image formation with reference to FIG. 3. Herein, FIG. 3 is a diagram in which the configuration of the photosensitive member 1, the configuration of the developing unit 3, the configuration of the high-voltage power supply 10, and the control signals [1] to [3] are illustrated in a simplified manner in the form of an equivalent circuit.

In FIG. 3, (A) represents hi/low timings of the control signal [1] during PWM control; (B) represents hi/low timings of the control signal [2] during PWM control; and (C) represents hi/low timings of the control signal [3] that performs the developing bias. Moreover, (D) represents the output timing of a charging bias Vc; (E) represents the output timing of a developing bias Vdv of the developing roller 6; (F) represents the output timing of a bias Vb of the regulating blade 8; and (G) represents the output timing of a bias Vs of the feed roller 7.

Herein, the configuration is such that the high-voltage power supply 10 can output a negative output (hereinafter, −output) as the charging output, and can output a positive output and a negative output (hereinafter, +output and −output, respectively) as the developing output. At the time of cleaning the photosensitive member 1, the developing output is set to +output. Moreover, at the time of forming an image using the electrostatic latent image formed on the photosensitive member 1, the charging output and the developing output are set to −output. In the following explanation, the voltage applied to the charging roller 2 is written as a charge Vc, while the voltage applied to the feed roller 7 is written as a supply Vs. Moreover, the voltage applied to the developing roller 6 is written as Vdv, while the voltage applied to the regulating blade 8 is written as Vb.

In this configuration, the charge Vc and the supply Vs are connected via the resistance R, and the circuit is such that a current Ir flows between the charge Vc and the supply Vs so that a current flows to the zener diodes 13 and 14 that are constant-voltage elements.

Figure 5:
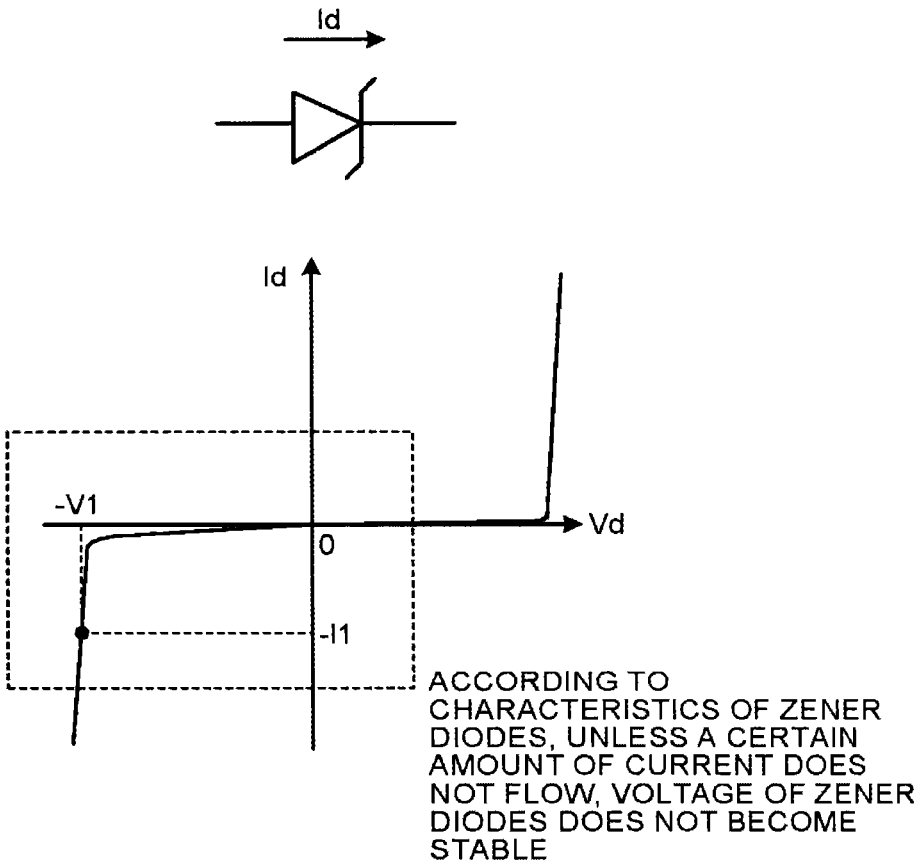
FIG. 5 is an explanatory diagram for explaining the characteristics of zener diodes that are constant-voltage elements.

FIG. 5 is an explanatory diagram for explaining the characteristics of zener diodes that are constant-voltage elements. The zener diodes 13 and 14 illustrated in FIG. 5 have a characteristic that, unless a certain current value is attained between them, a certain potential difference cannot be obtained in a stable manner. For that reason, the current value Ir flowing to the resistance R assumes significance.

During [2] image formation illustrated in FIG. 4B, since there is a large output difference between the normal charging and the developing. Hence, during image formation, the desired current Ir is obtained and a potential difference between the zener diodes 13 and 14 is obtained. However, in the conventional configuration, as illustrated in (D) in FIG. 3, during cleaning of [1] the photosensitive member 1, the charge Vc=0 is set. That is done to avoid charging of the photosensitive member 1.

During the cleaning of the photosensitive member 1, if a bias voltage is applied to the charging roller 2, then the photosensitive member 1 gets charged and an electrostatic latent image gets formed thereon. Thus, in the past, due to the concern about the residual toner present on the surface of the photosensitive member 1, output was not performed during the cleaning of the photosensitive member 1.

Hence, conventionally, in the case in which $Vd=\Delta V1+\Delta V2$ is satisfied as illustrated in FIG. 4A, the supply Vs and the charge Vc have the same electrical potential (of 0 V). For that reason, the current Ir does not flow to the resistance R. Consequently, the current Ir stops from flowing to the zener diodes 13 and 14. Therefore, there are times when a constant potential difference is not obtained in a stable manner among the developing roller 6, the regulating blade 8, and the feed roller 7. As a result, it is not possible to perform cleaning of the photosensitive member 1 in a stable manner.

Figure 6:
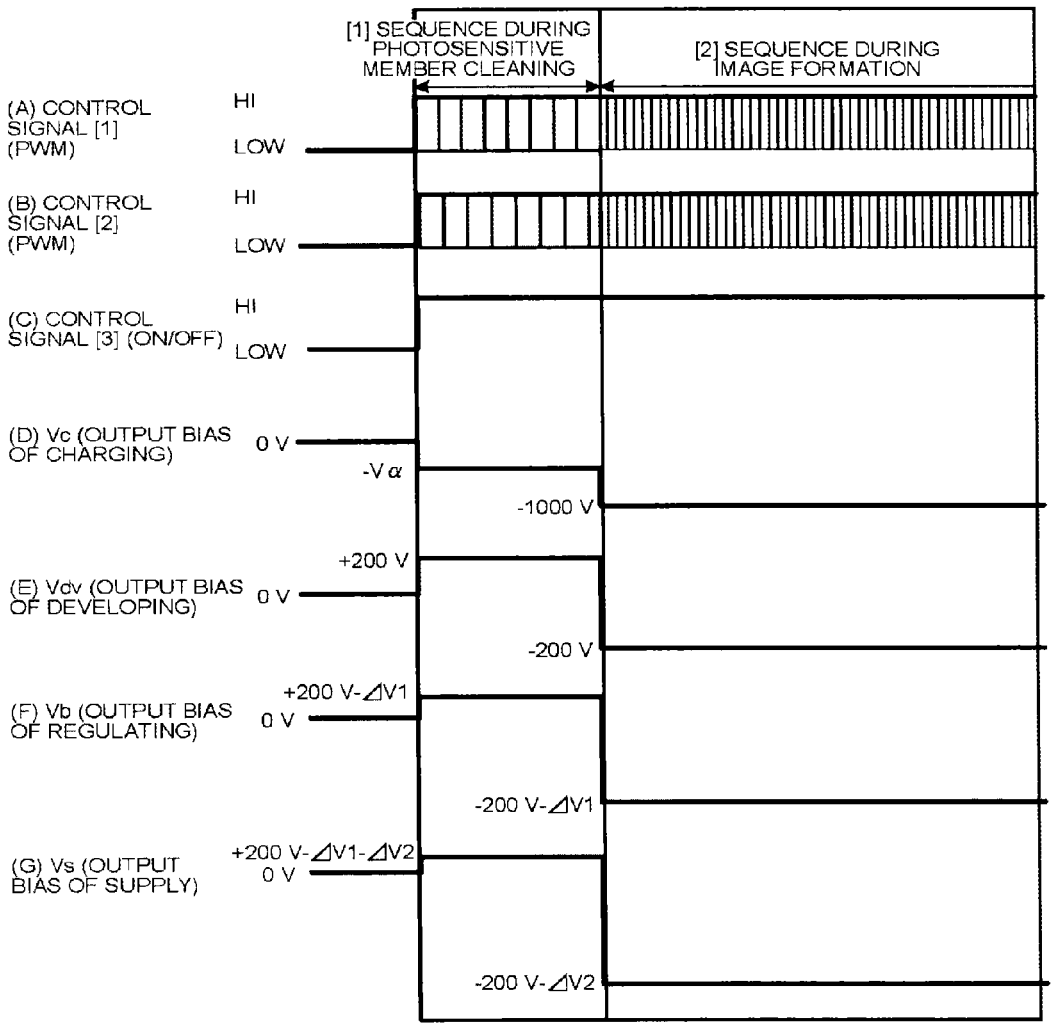
FIG. 6 is a timing chart illustrating a control sequence according to the present embodiment.
Figure 7A:
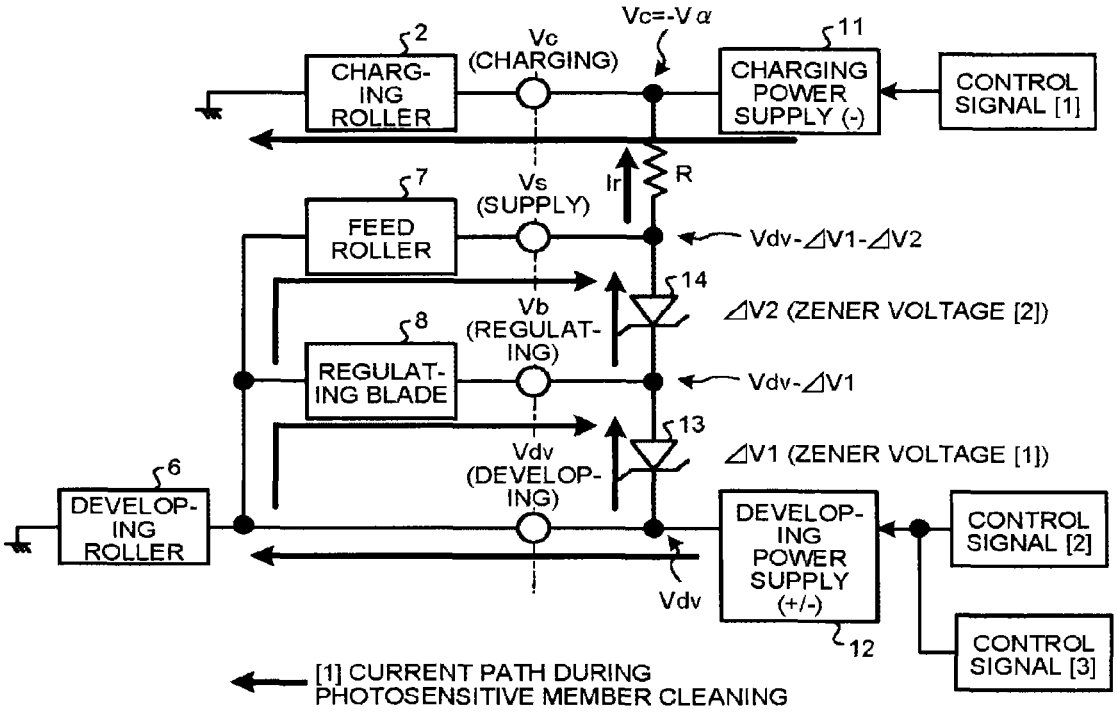
FIG. 7A is a circuit diagram illustrating a current path for photosensitive member cleaning with reference to FIG. 6.
Figure 7B:
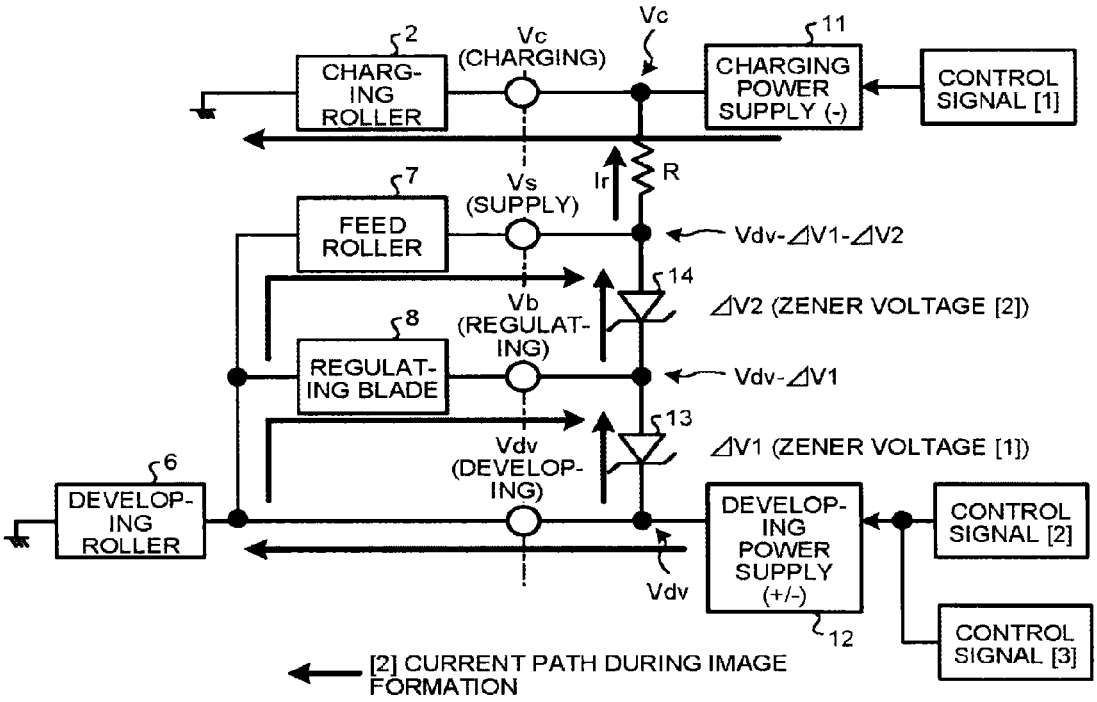
FIG. 7B is a circuit diagram illustrating a current path for performing image formation with reference to FIG. 6.

In that regard, in the present embodiment, the application of a bias power voltage is controlled in the following manner. FIG. 6 is a timing chart illustrating a control sequence according to the present embodiment. FIG. 7A is a circuit diagram illustrating a current path for photosensitive member cleaning with reference to FIG. 6. FIG. 7B is a circuit diagram illustrating a current path for performing image formation with reference to FIG. 6. With reference to the timing chart illustrated in FIG. 6, (A) to (G) are identical to FIG. 3. That is, (A) represents hi/low timings of the control signal [1] during PWM control; (B) represents hi/low timings of the control signal [2] during PWM control; and (C) represents hi/low timings of the control signal [3] that performs the developing bias. Moreover, (D) represents the output timing of the charging bias Vc; (E) represents the output timing of the developing bias Vdv of the developing roller 6; (F) represents the output timing of the bias Vb of the regulating blade 8; and (G) represents the output timing of the bias Vs of the feed roller 7. However, regarding (A) to (G), as illustrated in FIG. 6, the respective output timings are different than the output timings illustrated in FIG. 3, and the control unit 20 performs the following control. Meanwhile, with reference to (E) in FIG. 6, $-V\alpha$ represents the bias voltage for photosensitive member cleaning (see FIG. 8B).

In the present embodiment, as illustrated in the diagrams, the configuration is such that, even during the cleaning of the photosensitive member 1, the control signals [1] to [3] are used to apply, to the charge Vc, the bias voltage $-V\alpha$ that does not have the same electrical potential as the supply Vs which is the output via the resistance R (see (D) in FIG. 6). As a result, as illustrated in FIG. 7A, there occurs a potential difference between the bias of the charge Vc and the bias of the supply Vs, thereby enabling generation of the current Ir. Meanwhile, it is assumed that the charging power control unit 25 varies the output value of the charging bias voltage according to the voltage value of the developing bias voltage.

As described earlier, as a result of generating the current Ir in the resistance R, a current flows to the zener diodes 13 and 14 that are constant-voltage elements. Thus, the zener diodes 13 and 14 become stable at a constant potential difference. Consequently, it becomes possible to stabilize the potential difference among the developing roller 6, the regulating blade 8, and the feed roller 7 of the developing unit 3. With that, cleaning of the photosensitive member 1 can be performed in a stable manner.

Figure 8A:
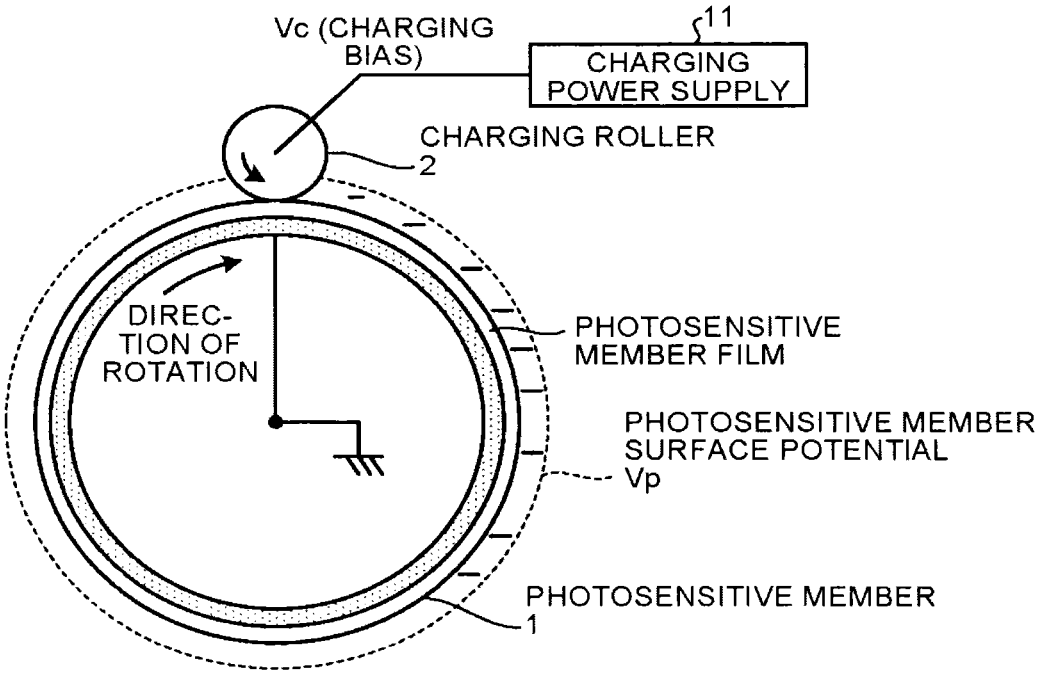
FIG. 8A is a schematic diagram illustrating a configuration of a photosensitive member included in the image forming device of the present embodiment.
Figure 8B:
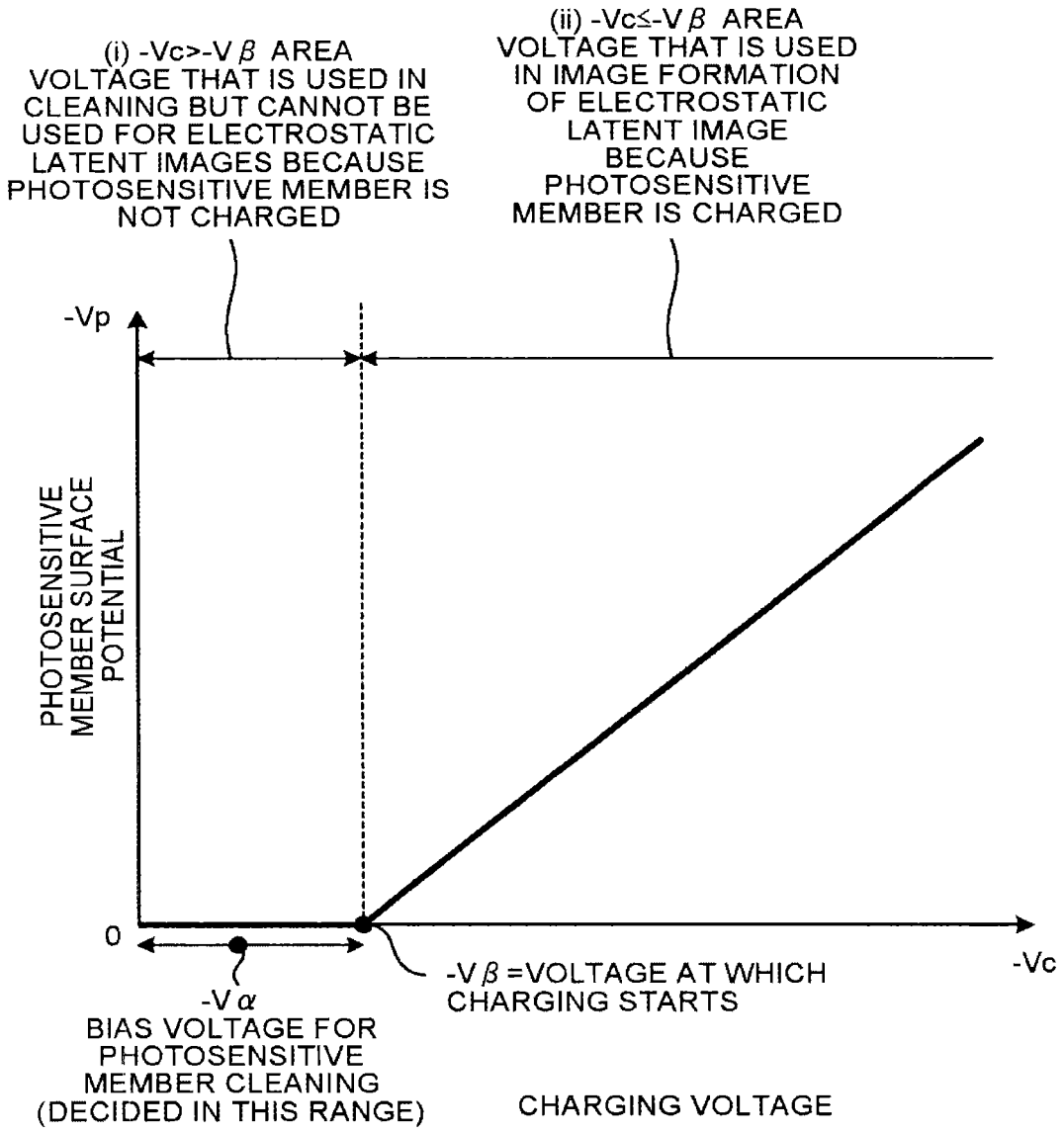
FIG. 8B is a graph of the photosensitive member surface potential against the charging voltage characteristics.

FIG. 8A is a schematic diagram illustrating a configuration of the photosensitive member. FIG. 8B is a graph of the photosensitive member surface potential against the charging voltage characteristics. In FIG. 8B, the vertical axis represents the photosensitive member surface potential, while the horizontal axis represents the charging voltage. The photosensitive member 1 has a characteristic that, due to the biasing of a voltage from the charging roller 2, the surface of the photosensitive member 1 gets charged from a particular voltage onward. That particular voltage is assumed to be $-V\beta$ (a charging start voltage). Moreover, $-Vp$ represents the surface potential of the photosensitive member 1, and $-Vc$ represents the voltage for biasing the charging roller 2.

In FIG. 8B, the $-Vc>-V\beta$ area illustrated in (i) represents the voltage that is used in cleaning but cannot be used for electrostatic latent images because the photosensitive member 1 is not charged. On the other hand, the $-Vc\leq-V\beta$ area illustrated in (ii) represents the voltage that is used in image formation of an electrostatic latent image because the photosensitive member 1 is charged.

As described above, the bias voltage $-V\alpha$ for photosensitive member cleaning is used in operating the constant-voltage elements (the zener diodes 13 and 14) at the time of cleaning the photosensitive member 1. Hence, when the photosensitive member 1 gets charged and has a surface potential, the toner gets electrostatically attached to the surface of the photosensitive member 1 thereby resulting in the loss of the cleaning property. For that reason, the bias voltage $-V\alpha$ for photosensitive member cleaning is used in the area ($-Vc>-V\beta$) in which the photosensitive member 1 is not charged.

If the bias voltage $-V\alpha$ for photosensitive member cleaning illustrated in FIG. 8B is set in the $-Vc>-V\beta$ area illustrated in (i), then no electrostatic latent image is formed on the photosensitive member 1, and it is possible to generate the charging voltage. Hence, the potential difference among the constant-voltage elements (the zener diodes 13 and 14) becomes stable. As a result, it becomes possible to clean the photosensitive member 1 in a stable manner.

Meanwhile, the bias voltage $-V\alpha$ applied to the charging roller 2 and used for the purpose of cleaning the photosensitive member 1 can be used in an area of voltage equal to or smaller than the voltage $-V\beta$ at which the photosensitive member 1 starts getting charged. Hence, the bias voltage $-V\alpha$ can be set to be a variable value instead of a constant value.

Thus, according to the embodiment described above, the configuration is such that the charging output is output even during a developing output of reverse polarity to the polarity of charging. Hence, for example, even if the developing is of reverse polarity, the output from the rear end of the constant-voltage elements does not have the same electrical potential as the electrical potential of the charging output. Hence, regardless of the positive developing output or the negative developing output, it becomes possible to generate a current from the charging. For that reason, the voltage of the constant-voltage elements in the current path becomes stable, and a stable potential difference can be obtained.

Meanwhile, for the purpose of cleaning the photosensitive member 1, if the developing output is of reverse polarity to the polarity of charging; then a charging bias adjusted to not charge the photosensitive member 1 is applied. With that, it becomes possible to create a current path to the constant-voltage elements, to stabilize the potential difference between the constant-voltage elements, and perform a stable cleaning operation of the photosensitive member 1 without making the circuitry complex.

Meanwhile, a computer program executed according to the present embodiment is stored in advance in the ROM 22. However, that is not the only possible case. Alternatively, the computer program executed according to the present embodiment can be recorded as an installable or executable file in a computer-readable recording medium such as a compact disk read only memory (CD-ROM), a flexible disk (FD), a compact disk readable (CD-R), or a digital versatile disk (DVD).

Still alternatively, the computer program executed according to the present embodiment can be saved in a downloadable manner on a computer connected to a network such as the Internet. Still alternatively, the computer program executed according to the present embodiment can be distributed over a network such as the Internet.

The computer program stored in the ROM 22 and executed according to the present embodiment contains modules for the charging power control unit 25 and the developing power control unit 26. As the actual hardware, for example, the CPU 21 (processor) reads the computer program from the recording medium mentioned above and runs it so that the computer program is loaded in a main memory device such as the RAM 23. As a result, the module for each constituent element is generated in the main memory device.

According to an aspect of the present invention, it becomes possible to perform a stable cleaning operation of a photosensitive member without making the circuitry complex.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming device comprising:

a charging power supply that is used in applying, to a charging unit, a charging voltage for the purpose of electrostatic latent image formation and a charging bias voltage during a cleaning operation;

a developing power supply that is capable of outputting a developing bias voltage of positive polarity and negative polarity to a developing unit;

a constant-voltage generating-holding unit that is used in generating and holding a constant potential difference between the charging unit and the developing unit;

a developing power control unit that performs output control of a developing bias voltage with respect to the developing unit; and a charging power control unit that, when the developing power control unit performs control to output a developing bias voltage of reverse polarity to the charging unit, performs output control of the charging bias voltage of a predetermined level with respect to the charging power supply.

2. The image forming device according to claim 1, wherein a rear end output of the constant-voltage generating-holding unit is connected to the charging unit via a resistance, and the charging power control unit performs control to output a charging bias voltage that does not have a same electrical potential as an electrical potential of the rear end output of the constant-voltage generating-holding unit via the resistance.

3. The image forming device according to claim 2, wherein, at the time of performing output control of the charging bias voltage of a predetermined level with respect to the charging power supply, the charging power control unit performs control to output a charging bias voltage with which a photosensitive member serving as an image carrier does not get charged.

4. The image forming device according to claim 3, wherein the charging power control unit performs control to vary an output value of the charging bias voltage according to a voltage value of the developing bias voltage.

5. The image forming device according to claim 1, wherein the constant-voltage generating-holding unit includes a zener diode as a constant-voltage element.

6. A bias voltage control method for an image forming device that includes a charging power supply that is used in applying, to a charging unit, a charging voltage for the purpose of electrostatic latent image formation and applying a charging bias voltage during a cleaning operation, a developing power supply that is capable of outputting a developing bias voltage of positive polarity and negative polarity to a developing unit, and a constant-voltage generating-holding unit that is used in generating and holding a constant potential difference between the charging unit and the developing unit, the bias voltage control method for an image forming device, comprising:

developing-power-controlling that includes performing output control of a developing bias voltage with respect to the developing unit; and charging-power-controlling that, when a developing bias voltage of reverse polarity is output to the charging unit at the developing-power-controlling, includes performing output control of the charging bias voltage of a predetermined level with respect to the charging power supply.

7. A computer program product comprising a non-transitory computer readable medium having a computer program executed by a computer, wherein the computer includes;

a charging power supply that is used in applying, to a charging unit, a charging voltage for the purpose of electrostatic latent image formation and applying a charging bias voltage during a cleaning operation, a developing power supply that is capable of outputting a developing bias voltage of positive polarity and negative polarity to a developing unit, and a constant-voltage generating-holding unit that is used in generating and holding a constant potential difference between the charging unit and the developing unit, and the program causes the computer to execute:

developing-power-controlling that includes performing output control of a developing bias voltage with respect to the developing unit; and charging-power-controlling that, when a developing bias voltage of reverse polarity is output to the charging unit at the developing-power-controlling, includes performing output control of the charging bias voltage of a predetermined level with respect to the charging power supply.

* * * * *